US007503518B2

(12) United States Patent
Corrado et al.

(10) Patent No.: US 7,503,518 B2
(45) Date of Patent: Mar. 17, 2009

(54) METHOD AND APPARATUS FOR FORMING A SHEETED ROLL OF MATERIAL

(75) Inventors: Frank C. Corrado, Rochester, NY (US); Gary R. Larsen, Webster, NY (US); Ronald W. Sweet, Conesus, NY (US); James W. Fischer, Rochester, NY (US)

(73) Assignee: Seratek, LLC, Rochester, NY (US)

( * ) Notice: Subject to any disclaimer, the term of this patent is extended or adjusted under 35 U.S.C. 154(b) by 45 days.

(21) Appl. No.: 11/691,818

(22) Filed: Mar. 27, 2007

(65) Prior Publication Data

US 2007/0181734 A1 Aug. 9, 2007

Related U.S. Application Data

(63) Continuation-in-part of application No. 11/422,236, filed on Jun. 5, 2006.

(60) Provisional application No. 60/687,675, filed on Jun. 6, 2005.

(51) Int. Cl.
*B65H 35/08* (2006.01)

(52) U.S. Cl. ..... 242/526; 242/527; 242/527.4; 242/532.2

(58) Field of Classification Search ..... 242/527, 242/527.4, 527.7, 526.2, 526, 532.2, 528
See application file for complete search history.

(56) References Cited

U.S. PATENT DOCUMENTS

| | | | | | |
|---|---|---|---|---|---|
| 3,179,348 | A | * | 4/1965 | Nystrand et al. | 242/527.1 |
| 3,549,097 | A | * | 12/1970 | Seigh | 242/523.1 |
| 3,552,670 | A | * | 1/1971 | Herman | 242/527.1 |
| RE28,353 | E | * | 3/1975 | Nystrand et al. | 242/527.1 |
| 4,009,047 | A | | 2/1977 | Lindsay | |
| 4,408,727 | A | * | 10/1983 | Dropczynski | 242/521 |
| 5,335,869 | A | * | 8/1994 | Yamaguchi et al. | 242/526 |
| 5,360,179 | A | * | 11/1994 | Vesterinen et al. | 242/526.3 |
| 6,196,128 | B1 | | 3/2001 | Corrado et al. | |
| 6,805,316 | B2 | * | 10/2004 | Wojcik et al. | 242/527.1 |
| 2006/0057322 | A1 | | 3/2006 | Kennett et al. | |

* cited by examiner

*Primary Examiner*—Sang Kim
(74) *Attorney, Agent, or Firm*—Woods Oviatt Gilman LLP

(57) ABSTRACT

A web-chopping and sheet-winding apparatus comprising an unwinder for unwinding a supply roll of continuous flexible web which may be adhesive on at least one side. A knife roller including at least one fixed transverse knife blade extending from the surface is in nipped relationship with an anvil roller, the height of the knife blade being greater than the thickness of the web. The anvil and knife roller spacing is such that the knife blade extends just to the surface of the anvil roller, thereby chopping the continuous web into sheets as the anvil and knife rollers turn synchronously with the web passing therebetween. A tape core roller in nipped relationship receives the chopped sheets sequentially, the leading edge of each sheet being lifted from the anvil roller by any of a plurality of novel means.

12 Claims, 7 Drawing Sheets

METHOD AND APPARATUS FOR FORMING A SHEETED ROLL OF MATERIAL

RELATIONSHIP TO OTHER APPLICATIONS AND PATENTS

The present application is a Continuation-In-Part of a pending U.S. patent application, Ser. No. 11/422,236, filed Jun. 5, 2006, which takes priority from Provisional Application Ser. No. 60/687,675, filed Jun. 6, 2005.

TECHNICAL FIELD

The present invention relates to method and apparatus for forming a wound roll of material; more particularly, to method and apparatus for forming a wound roll of material comprising overlapping sheets; and most particularly, to method and apparatus for forming such a roll wherein the sheets have an adhesive layer on at least one side thereof.

BACKGROUND OF THE INVENTION

Methods and apparatus are known for forming a roll of tape material, known in the art as a "sheeted roll", comprising individual sheets of material wound concentrically about a core. Typically, the sheets are all of the same length, so the degree of overlap of sheets decreases as the roll diameter increases during winding of the roll, and typically, the ends of adjacent sheets are abutting. Such rolls, when wound with an adhesive surface facing outwards from the core, are useful, for example, in cleaning particles from a substrate surface by transferring the particles to the adhesive surface when the roll is rolled along the substrate surface. In such use, the roll is known in the art as a "particle transfer roller" (PTR) or a "contact cleaning roller" (CCR).

U.S. Patent Application Publication No. U.S. 2006/0057322 A1, published Mar. 16, 2006, the relevant disclosure of which is incorporated herein by reference, discloses a method and apparatus for forming a sheeted roll from a continuous length of such material. Continuous material having an adhesive coating is passed around a cutting roller having a traversing knife which is disposed therewithin and is selectively retractable below the surface of the cutting roller. At designated intervals, the knife is extended and traverses the continuous material, cutting therefrom a length of material defining a sheet which is then removably applied to a sheeting roller. Successive sheets, when so cut and applied to a sheeting roller, which preferably includes an inert core, define a sheeted roll in accordance with the prior art and the present invention.

A problem arises in applying the disclosed prior art to practice. The apparatus shown in FIG. 4 thereof for forming the sheeted roll shows the sheeted roll 110 being distinctly off-spaced from cutting roller 312 by an unidentified gap. The specification is silent as to how the leading edge of an adhesive sheet, which is now severed from its predecessor and therefore is discontinuous, is to be transferred from the cutting roller to the sheeting roller. The present invention is directed to method and apparatus for reliably effecting such transfer.

What is needed in the art is means for transferring sequential discontinuous sheets from a cutting roller to a sheeting roller to form a sheeted roll of material.

It is a principal object of the present invention to form a sheeted roll of material.

SUMMARY OF THE INVENTION

Briefly described, an apparatus in accordance with the invention comprises an unwinder for unwinding a supply roll of continuous flexible material, also referred to herein as a web, which may be adhesive on at least one side. The web is passed around a variable-position dancer roller that maintains tension in the web and steers the web onto the surface of an anvil roller. A knife roller including at least one fixed transverse knife blade extending from the surface of the knife roller is in nipped relationship with the anvil roller, the height of the knife blade being greater than the thickness of the web. The spacing of the axes of the anvil roller and the knife roller is such that the knife blade extends just to the surface of the anvil roller, thereby chopping the continuous web into sheets as the anvil and knife rollers turn synchronously. A tape core roller is also in nipped relationship against the severed web on the anvil roller. As the leading edge of each sheet passes through the nip, the edge is lifted from the anvil roller by any of a plurality of novel means and is directed onto the tape core roller in abutting relationship to the trailing edge of the previous sheet.

BRIEF DESCRIPTION OF THE DRAWINGS

The present invention will now be described, by way of example, with reference to the accompanying drawings, in which.

DESCRIPTION OF THE PREFERRED EMBODIMENTS

Figure 1:
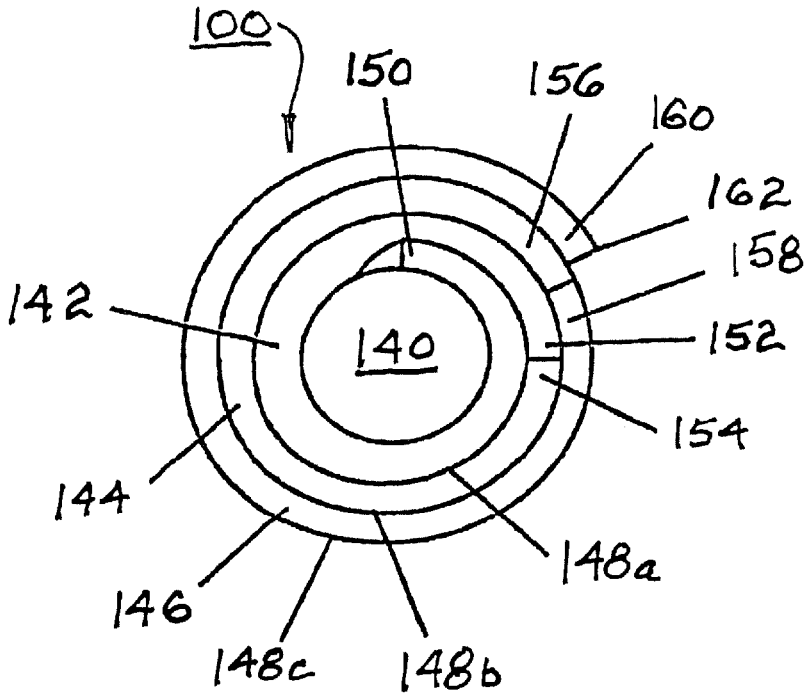
FIG. 1 (PRIOR ART)
FIG. 1 is a schematic cross-sectional view of a prior art sheeted tape roll as disclosed in U.S. Patent Application Publication No. U.S. 2006/0057322 A1.

Referring to FIG. 1, a sheeted roll of adhesive tape 100 is substantially as disclosed in U.S. Patent Application Publication No. U.S. 2006/0057322 A1 and the parent to the present application. Sheeted tape roll 100 comprises a conventional roll core 140 with individual adhesive sheets 142, 144, 146 removably attachable around the circumference of the roll core 140 superimposed onto one another. The roll core 140 has an attachment means which may be an adhesive coating to allow the first individual adhesive sheet 142 to be removably attachable around the circumference of the roll core 140. The individual adhesive sheets 142, 144, 146 have an adhesive surface 148*a-c* facing outwardly, and have a non-adhesive surface facing inwardly. Alternatively the individual sheets can be rolled such that the adhesive surfaces are facing inwardly and the non-adhesive surfaces are facing outwardly.

The sheeted roll 100 is formed by attaching a first end 150 of the first sheet 142 onto the roll core 140 and wrapping the first sheet 142 around the circumference of the roll core 140. The other end 152 of the first sheet 142 will overrun first end 150 by virtue of first sheet 142 being greater in length than the circumference of the roll core 140. The end 152 is removably attached onto end 150 by the adhesive surface 148*a* of the first sheet 142.

A second sheet 144 is then wrapped around the outer circumference of the first sheet 142 with end 154 of the second sheet 144 being abutted to end 152 of the first sheet 142. The term abutted is to be understood to include being adjacent to, as there may be a gap between successive sheets. The adhesive surface 148*a* of the first sheet 142 will securely hold in place the second sheet 144.

A third sheet 146 is then wrapped around the outer circumference of the second sheet 144 with end 158 of the third sheet 116 being abutted to end 156 of the second sheet 114. The adhesive surface 148*b* of the second sheet 144 will securely hold in place the third sheet 146. Similarly, further individual adhesive sheets (not shown) are abutted to end 160 of the third sheet 146 and so on until the roll core 140 is "full".

It will be realized that because the sheets 142, 144, 146 are all of the same length, the overrun or circumferential offset of the respective ends 152, 156, 160, and so on, will decrease as the roll core 140 becomes "full". The length of each sheet can however be adjusted as desired or required. The offset of the abutment of the ends of the sheets disperses the load on the roll core 140 making the roll core 140 more stable when rotating.

Figure 2:
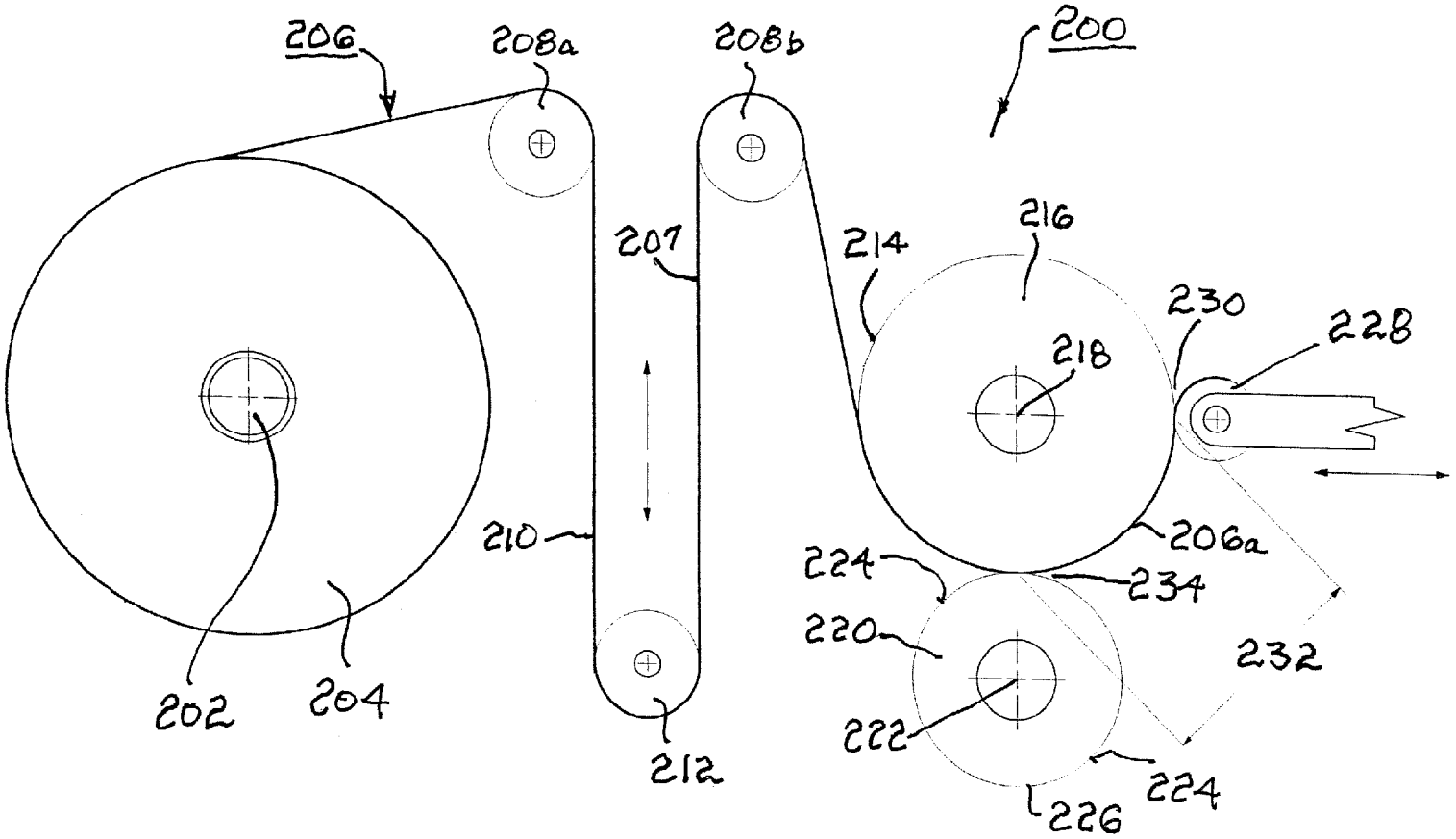
FIG. 2 is a schematic cross-sectional view of a generalized apparatus embodiment in accordance with the invention for forming a sheeted roll of material.

Referring now to FIG. 2, a generalized embodiment 200 of an apparatus in accordance with the invention for forming a sheeted tape roll like roll 100 (FIG. 1) comprises an unwinder 202 for unwinding a supply roll 204 of continuous flexible material 206, also referred to herein as a web, which may be adhesive 207 on at least one side. The web 206 is passed around a pair of fixed rollers 208*a*, 208*b*, forming a loop 210 therebetween including a variable-position dancer roller 212 that maintains tension in the web and steers the web onto the surface 214 of an anvil roller 216 having an axis of rotation 218. Preferably, surface 214 and the surface of dancer roller 212 are formed of an adhesion-release material such as Teflon such that an adhesive side 207 may be passed into and out of continuous, dynamic contact therewith without sticking. A knife roller 220 having an axis of rotation 222 includes at least one fixed transverse knife blade 224 extending from the surface 226. Axes 218,222 are spaced apart such that the knife roller 220 is in nipped relationship with the anvil roller 216, the height of the knife blade above surface 226 being greater than the thickness of the web 206. The anvil and knife roller spacing is such that the knife blade 224 extends just to the surface 214 of the anvil roller 216, thereby chopping the continuous web 206 into sheets as the anvil and knife rollers turn synchronously. A tape core roller 228 is also in nipped relationship against the severed web (sheet) 206*a* on the anvil roller 216. As the leading edge of each sheet 206*a* passes through the nip 230, the leading edge is lifted from the anvil roller surface 214 and is directed onto the tape core roller in abutting relationship to the trailing edge of the previous sheet.

Note that the circumferential distance on knife roller 220 between adjacent of a plurality of knives is preferably greater than the starting circumference of tape core roller 228, such that the first sheet 206*a* being wound on the core overlaps itself (corresponding to first sheet 142 in prior art roll 100 in FIG. 1), thereby assuring that the first sheet adheres to itself at the overlap. Note further that this is also the circumferential distance 232 on the surface of anvil roller 216 between the cutting point 234 and the removal nip 230.

The diameter of the core of roll 228 governs how long the first sheet should be, both of which may be driven by an end use. If the sheeted roll is to be used for contact cleaning of a substrate, wherein the adhesive surface faces outwards and wherein each outer sheet when saturated with particles is removed and discarded to expose a fresh sheet beneath, it is important that the sheets be long enough such that the initial outermost sheet overlaps itself, else a portion of the next sheet inwards is initially exposed and thus contaminated between the non-abutting ends of the outermost sheet. If the outermost sheet does not overlap itself, removing the saturated outermost sheet must leave an unacceptable transverse stripe of contamination on the next inner sheet of the cleaning roller. However, all such overlap represents waste, in that the overlapped portion is never exposed for particle removal and is discarded with the used portion. Thus, the knife spacing and sheet length are optimally provided when the outermost sheet barely overlaps itself, the overlap of each sheet on itself thus becoming progressively greater (with a fixed sheet length) for sheets progressively nearer to the core. This is an important strategy to minimize waste of adhesive material. It also dictates that optimally the core is relatively large in diameter, while the band of sheet windings on the core is relatively thin and occupies relatively little of the total roll diameter.

Figure 3:
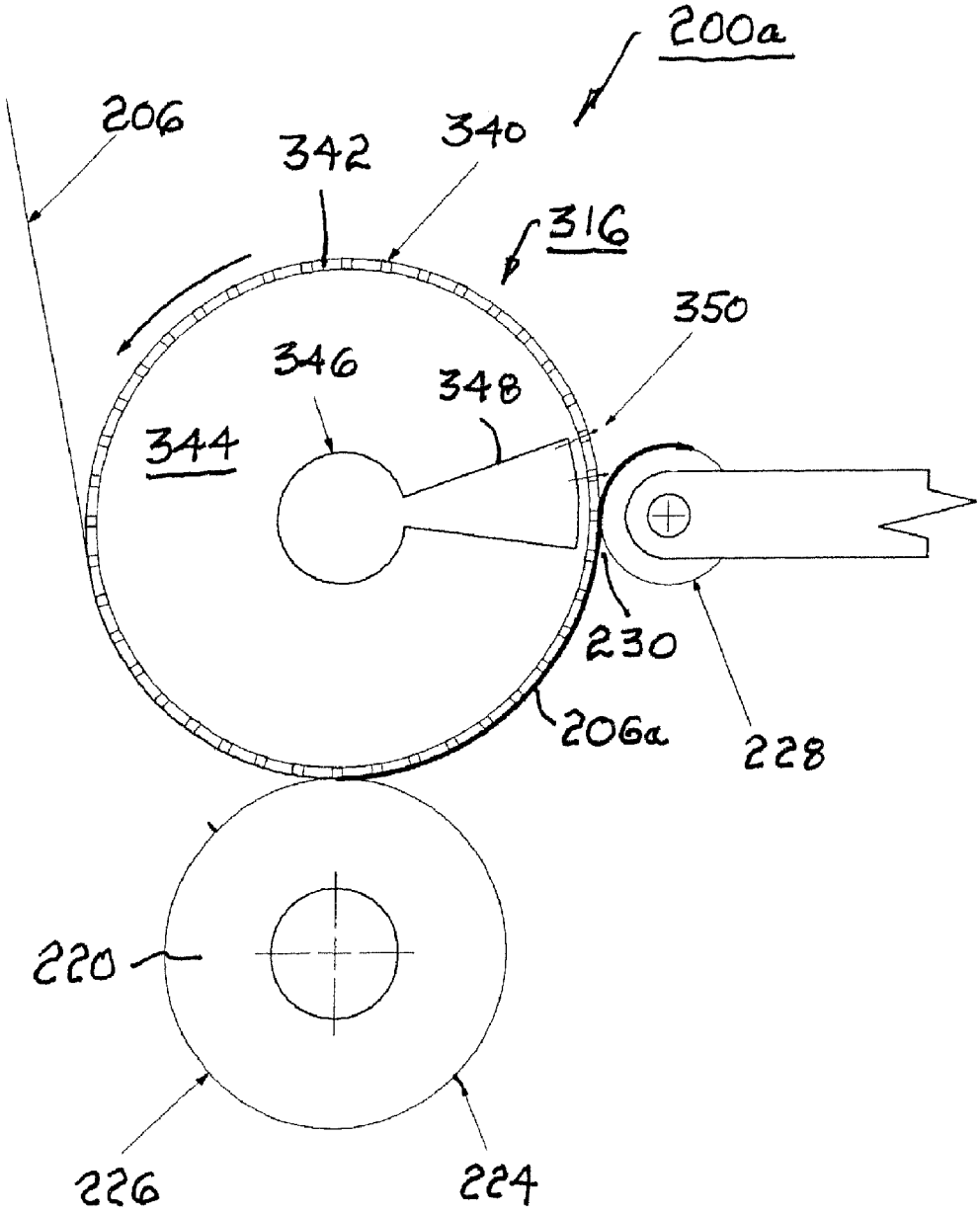
FIG. 3 is a schematic cross-sectional view of a portion of the embodiment shown in FIG. 2 showing a first apparatus for transferring cut sheets from the anvil roller to the tape core roller.

Referring now to FIG. 3, a first specific embodiment 200*a* of general embodiment 200 for removing sheet 206*a* from the anvil roller comprises a hollow anvil roller 316 having a plurality of perforations 340 in a roller shell 342 in communication between the hollow roller interior 344 and the exterior of the roller. A stationary air plenum 346 including a transverse snout 348 is disposed within anvil roller 316 and is supplied with air from a pressurized air source (not shown) such that jets of air 350 flow from the perforations as they pass snout 348, thereby urging cut sheet 206*a* away from the surface of anvil roller 316 and lifting the cut sheet into continuing contact with the outer surface of tape winding roll 228 after nip 230.

Figure 4:
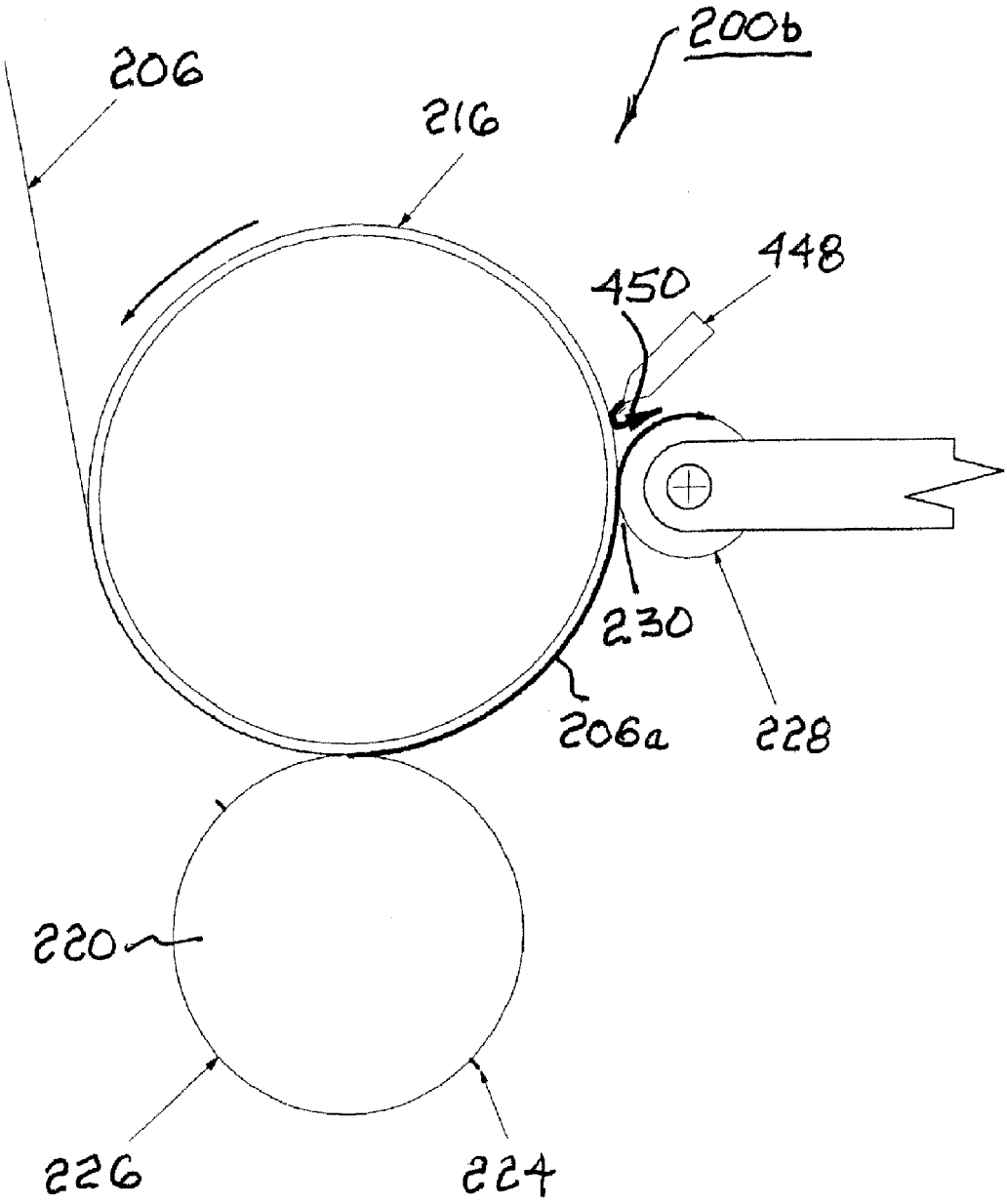
FIG. 4 is a schematic cross-sectional view of a portion of the embodiment shown in FIG. 2 showing a second apparatus for transferring cut sheets from the anvil roller to the tape core roller.
Figure 6:
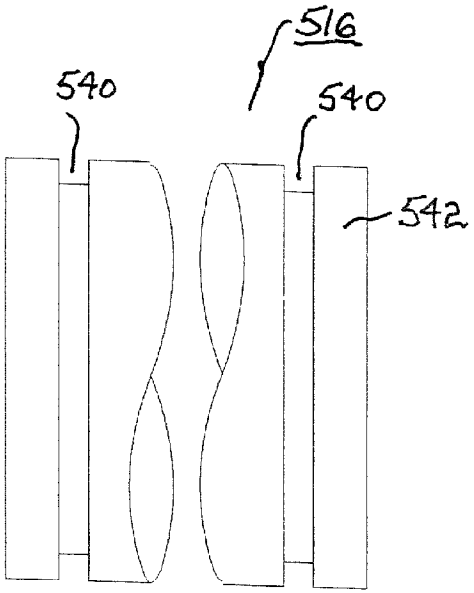
FIG. 6 is a plan view of a grooved anvil roller for use in the third apparatus shown in FIG. 5.

Referring now to FIG. 4, a second specific embodiment 200*b* of general embodiment 200 for removing sheet 206*a* from the anvil roller 216 comprises a hollow transverse air knife 448 having a transverse slot adjacent nip 230 and supplied with air from a pressurized air source (not shown) such that a linear jet or high-velocity curtain of air 450 flows continuously from the slot, thereby separating cut sheet 206*a* from the surface of anvil roller 216 after nip 230 and lifting the cut sheet into continuing contact with the outer surface of tape winding roll 228.

Figure 5:
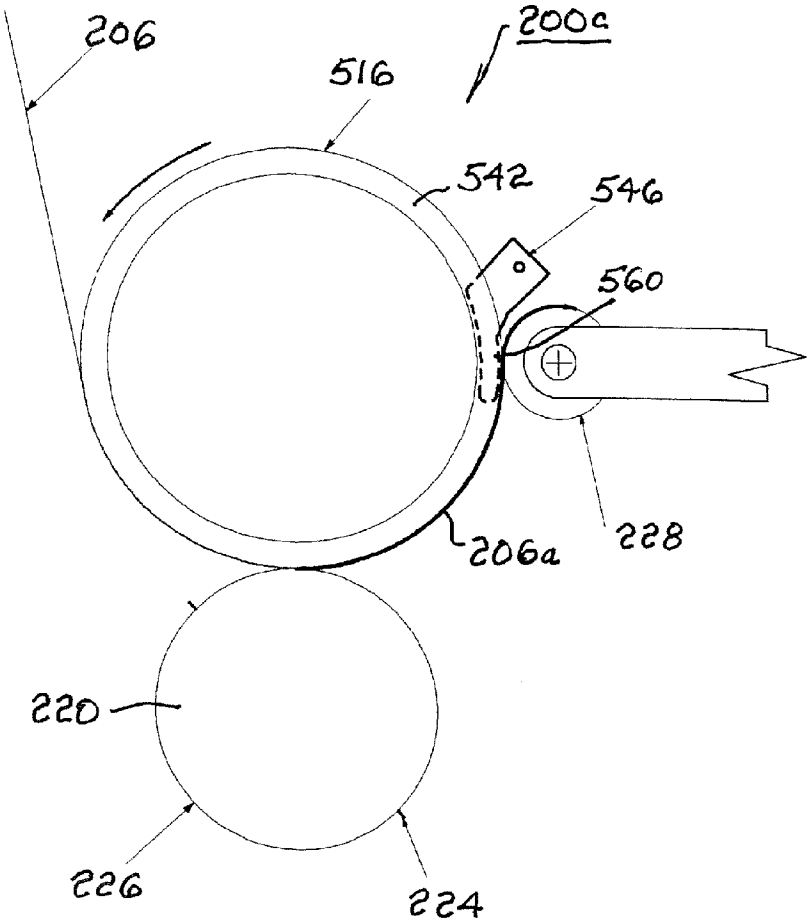
FIG. 5 is a schematic cross-sectional view of a portion of the embodiment shown in FIG. 2, showing a third apparatus for transferring cut sheets from the anvil roller to the tape core roller.

Referring now to FIG. 5, a third specific embodiment 200*c* of general embodiment 200 for removing sheet 206*a* from the anvil roller comprises an anvil roller 516 having a plurality of annular, spaced-apart grooves 540 in a roller shell 542. A plurality of stationary stripping fingers 546 are disposed in the plurality of grooves 540 such that cut sheet 206*a* is guided by the stripping fingers away from the surface of anvil roller 516 and lifted into continuing contact with the outer surface of tape winding roll 228 after nip 230. Preferably, stripping fingers 546 are provided with a non-stick coating similar to that applied to the surfaces of anvil roller 216 and dancer roller 212 in FIG. 2. Additionally or alternatively, each of the stripping fingers 546 may be formed as hollow with a slot formed in the surface 560 thereof. Pressurized air is supplied to each of the stripping fingers which, flowing from the slots, causes cut sheet 206*a* to be lifted away from the surface of anvil roller 516 and into continuing contact with the outer surface of tape winding roll 228.

Figure 7:
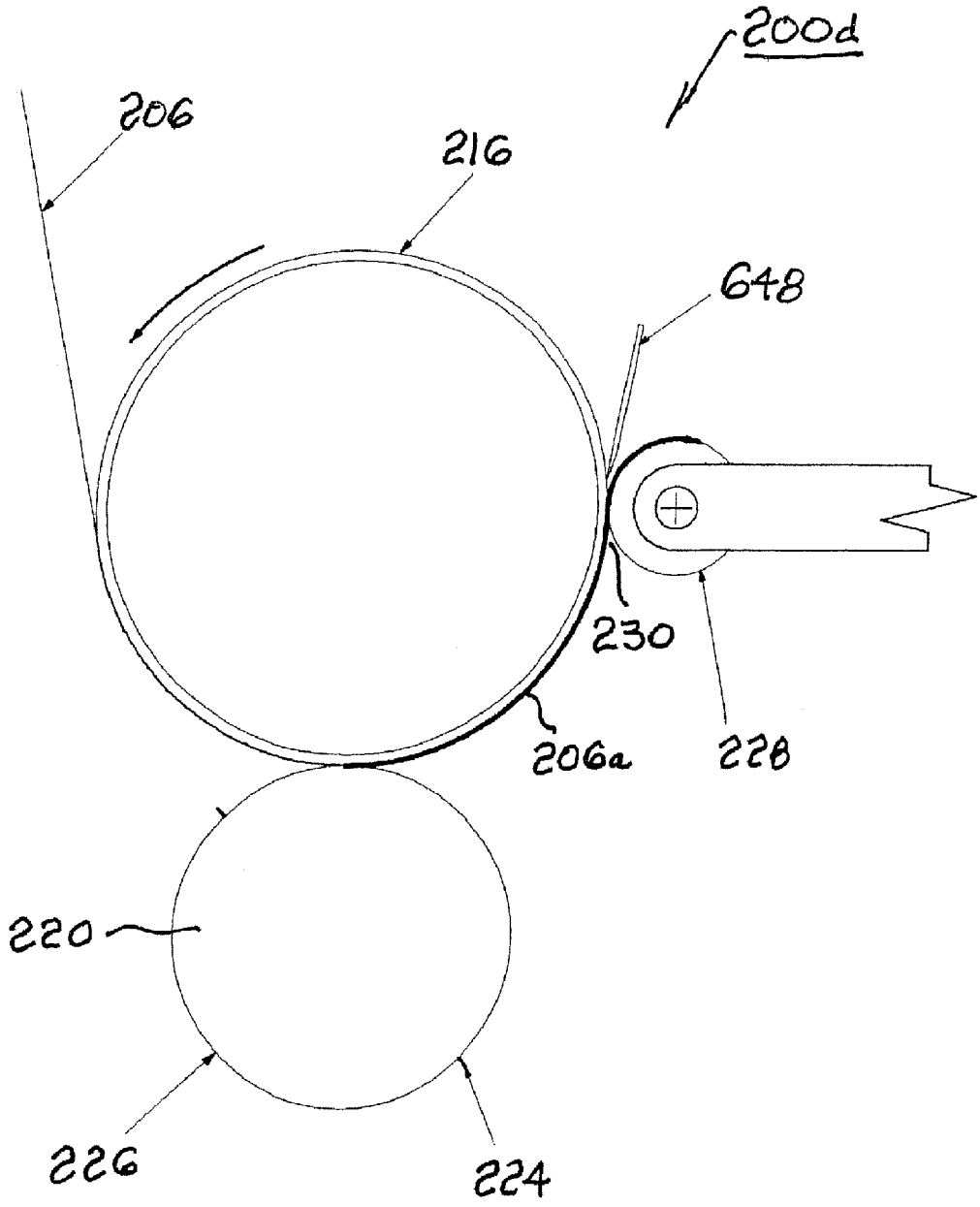
FIG. 7 is a schematic cross-sectional view of a portion of the embodiment shown in FIG. 2 showing a fourth apparatus for transferring cut sheets from the anvil roller to the tape core roller.

Referring now to FIG. 7, a fourth specific embodiment 200*d* of general embodiment 200 for removing sheet 206*a* from the anvil roller 216 comprises a transverse doctor blade 648 having an edge disposed against surface 214 of anvil roller 216 adjacent nip 230 such that cut sheet 206*a* is separated from the surface of anvil roller 216 after nip 230 and lifted into continuing contact with the outer surface of tape winding roll 228.

Within the scope of the present invention, the term "cut" should be taken to mean both completely severed and also partially severed in terms of either the thickness or the transverse width of web 206. For example, continuous web 206 may be the width of several finished wound rolls 100 and may undergo the cutting process described above and wound as a wide roll which is subsequently sliced into a plurality of narrower finished wound rolls 100. In such a process, it can be beneficial to have the web remain continuous along the edges and perhaps in the center to facilitate winding and handling of the web prior to final slicing. Also, it may be desirable that the web be only perforated, similar to the perforations of paper towels or toilet paper in the prior art, wherein the final separation and formation of a discrete sheet is left to the user. All such definitions and embodiments of "cut" and "sheet" are comprehended by the present invention.

Figure 8:
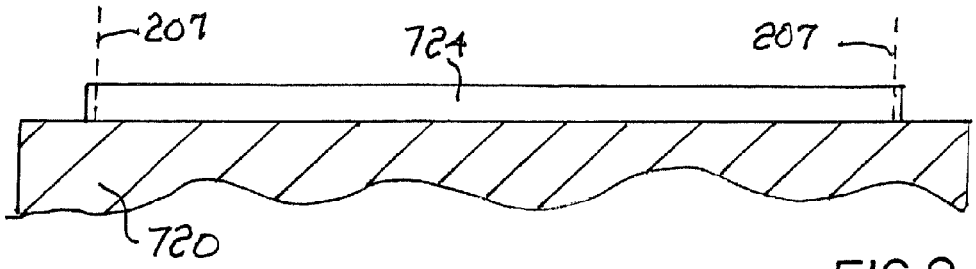
FIG. 8 is a cross-sectional view of an exemplary first embodiment of a knife roller and blade in accordance with the invention.

Referring to FIG. 8, a knife roller 720 is provided with a knife blade 724 that is continuous and extends beyond the edges 207 of a web being cut in accordance with the present invention. Thus the web is completely severed at nip 234 (FIG. 2).

Figure 9:
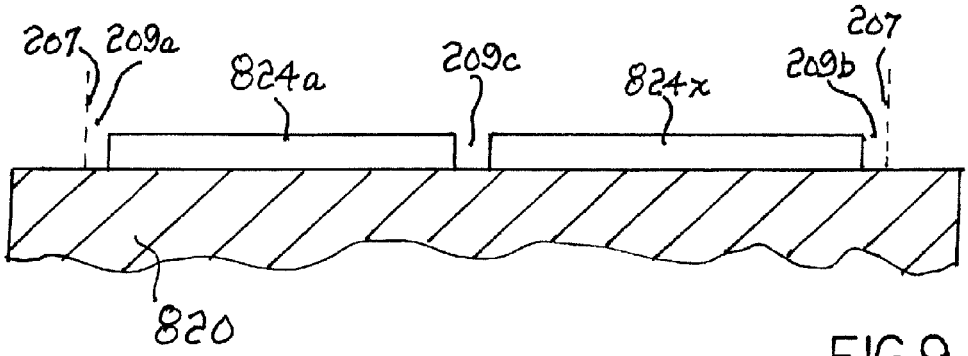
FIG. 9 is a cross-sectional view of an exemplary second embodiment of a knife roller and blade in accordance with the invention.

Referring to FIG. 9, a knife roller 820 is provided with a plurality of knife blade portions 824*a*, 824*x* whereby left and right web margins 209*a*, 209*b* and a web center portion 209*c* are left intact at nip 234 for later removal.

Figure 10:
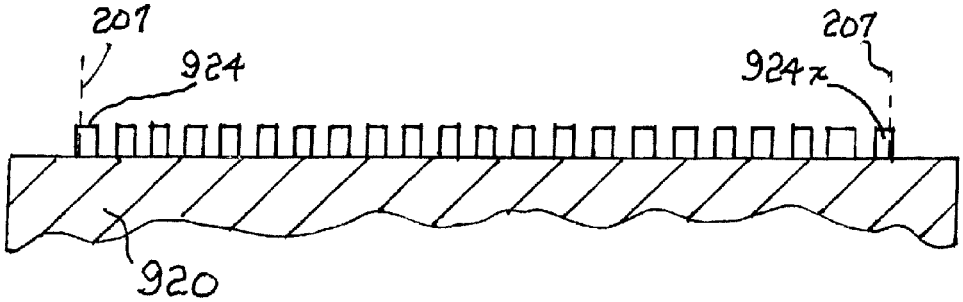
FIG. 10 is a cross-sectional view of an exemplary third embodiment of a knife roller and blade in accordance with the invention.

Referring to FIG. 10, a knife roller 920 is provided with a large plurality of perforating knife blade portions 924*a*, 924*x* whereby the web is discontinuously perforated across the web width such that subsequently a user may separate individual sheets by tearing out the web connections between the perforations as is known for perforated web materials in the prior art.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A system for forming a sheeted roll of material from a continuous roll of the material, comprising:

a) an anvil roller for receiving and conveying said continuous material around a portion of the circumferential surface thereof and having a first rotational axis;

b) a knife roller adjacent said anvil roller and having a fixed knife blade extending from a circumferential surface of a roller body and having a second rotational axis, wherein said first and second rotational axes are parallel and are spaced apart such that said knife blade extends just to said surface of said anvil roller for severing said continuous material into consecutive sheets thereof when said knife roller and said anvil roller, having said continuous material therebetween, are synchronously counter-rotated;

c) a sheet winding roller adjacent said anvil roller and having a third rotational axis parallel to said first and second rotational axes, wherein said sheet winding roller is in nipped relationship to a sheet of said material on said anvil roller surface; and d) means for lifting a sheet of said material from said anvil roller surface and directing said sheet onto said sheet winding roller for forming said sheeted roll of material from overlapping of said consecutive sheets.

2. A system in accordance with claim 1 wherein said knife roller comprises a plurality of said knife blades spaced apart around the circumference of said roller body.

3. A system in accordance with claim 1 wherein said knife blade comprises a plurality of segments such that said material is severed only partially across the width thereof.

4. A system in accordance with claim 1 wherein the length of each sheet is sufficient that each sheet overlaps a portion of itself when wound onto said sheet winding roller.

5. A system in accordance with claim 4 wherein the lengths of said consecutive sheets is constant.

6. A system in accordance with claim 4 wherein the lengths of said consecutive sheets is variable.

7. A system in accordance with claim 1 wherein said means for lifting a sheet comprises:

a) a perforated shell on said anvil roller; and b) air distribution means disposed within said perforated shell for directing air through said perforations in the direction of said nip between said anvil roller and said tape winding roller to urge said sheet away from said anvil roller surface.

8. A system in accordance with claim 7 wherein said air distribution means includes a fixed air plenum and a longitudinal snout extending from said fixed air plenum toward said perforated shell.

9. A system in accordance with claim 1 wherein said means for lifting a sheet comprises:

a) at least one groove formed circumferentially in said anvil roller surface; and b) at least one stripping finger disposed within said groove to urge said sheet away from said anvil roller surface.

10. A system in accordance with claim 9 wherein said stripping finger has a hollow interior for receiving pressurized air and is provided with a slot such that an air jet from said hollow interior is impinged from said slot upon said sheet to urge said sheet away from said anvil roller surface.

11. A system in accordance with claim 1 wherein said means for lifting a sheet comprises a doctor blade disposed against said anvil roller surface to urge said sheet away from said anvil roller surface.

12. A system in accordance with claim 1 wherein said means for lifting a sheet comprises an air knife disposed adjacent said nip for discharging a high-velocity curtain of air between said anvil roller surface and said sheet to urge said sheet away from said anvil roller surface.

* * * * *